US007419055B2

(12) United States Patent
Manuel

(10) Patent No.: US 7,419,055 B2
(45) Date of Patent: Sep. 2, 2008

(54) BREAKAWAY FOAM PACKING

(75) Inventor: James E. Manuel, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/759,650

(22) Filed: Jan. 16, 2004

(65) Prior Publication Data

US 2005/0155890 A1 Jul. 21, 2005

(51) Int. Cl.
*B65D 85/30* (2006.01)

(52) U.S. Cl. ..... 206/523; 206/521; 206/320

(58) Field of Classification Search ..... 206/320, 206/523, 485, 521, 586, 588, 591, 592, 453; 220/732, 902
See application file for complete search history.

(56) References Cited

U.S. PATENT DOCUMENTS 3,410,474 A * 11/1968 Keil ..... 206/586
3,511,990 A * 5/1970 Hauss ..... 206/454
4,122,946 A * 10/1978 Holley ..... 206/523
4,287,990 A * 9/1981 Kurick ..... 206/454
5,239,807 A 8/1993 Soleri ..... 53/451
6,004,605 A 12/1999 Comer et al. ..... 426/420
6,092,651 A * 7/2000 Miller ..... 206/523
6,105,765 A * 8/2000 Chu ..... 206/320
6,234,777 B1 5/2001 Sperry et al. ..... 425/46
6,298,989 B1 * 10/2001 Chu ..... 206/320
6,368,036 B1 4/2002 Vario ..... 410/98
6,488,153 B1 * 12/2002 Morris ..... 206/523

FOREIGN PATENT DOCUMENTS

GB 2246115 A * 1/1992
WO WO 9425369 A1 * 11/1994

* cited by examiner

*Primary Examiner*—J. Gregory Pickett
(74) *Attorney, Agent, or Firm*—Baker Botts L.L.P.

(57) ABSTRACT

Breakaway foam packing is disclosed. In one aspect, the present disclosure teaches a breakaway packing system for packaging an information handling system including a packing support designed to receive at least a portion of an information handling system. The packing support secures the information handling system within a shipping container. The breakaway packing system also includes at least one detachable joint formed in the packing support. The detachable joint operably detachable to cause the packing support to separate into sections.

18 Claims, 4 Drawing Sheets

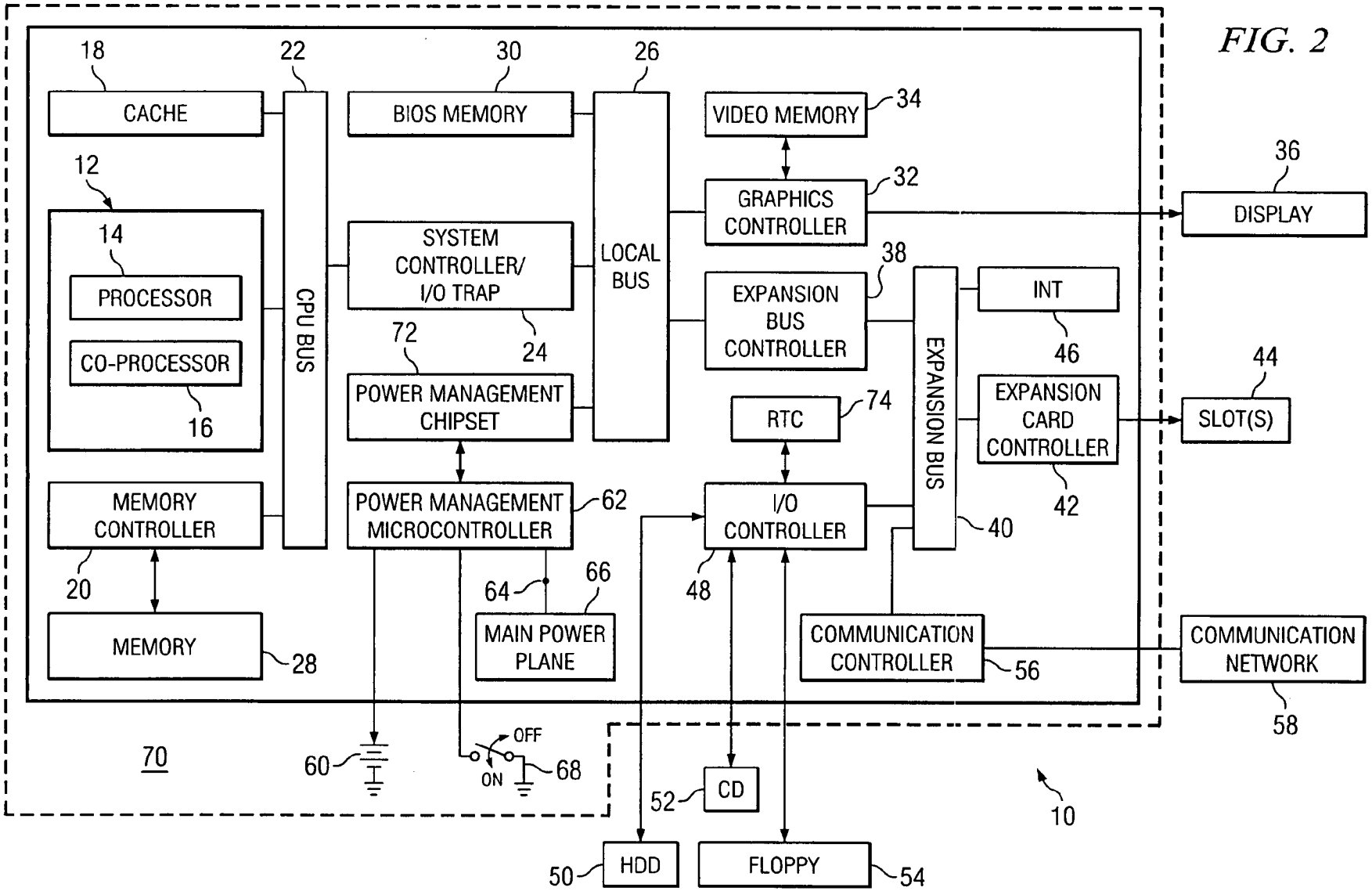
FIG. 2
DISPLAY
36
SLOT(S)
44
COMMUNICATION NETWORK
58
INT
46
EXPANSION CARD CONTROLLER
42
10
EXPANSION BUS
40
COMMUNICATION CONTROLLER
56
VIDEO MEMORY
34
GRAPHICS CONTROLLER
32
EXPANSION BUS CONTROLLER
38
RTC
74
I/O CONTROLLER
48
FLOPPY
54
CD
52
HDD
50
LOCAL BUS
26
BIOS MEMORY
30
SYSTEM CONTROLLER/ I/O TRAP
24
POWER MANAGEMENT CHIPSET
72
POWER MANAGEMENT MICROCONTROLLER
62
MAIN POWER PLANE
66
64
OFF
ON
68
60
CPU BUS
22
CACHE
18
PROCESSOR
14
CO-PROCESSOR
16
12
MEMORY CONTROLLER
20
MEMORY
28
70

BREAKAWAY FOAM PACKING

TECHNICAL FIELD

The present disclosure relates generally to information handling systems and, more particularly, to breakaway foam packing.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems including desktop and server systems are generally packaged for storage or shipment. One the goals of the packaging design is to create an optimal balance between factory throughput, cost, and customer satisfaction. Usually, the optimal balance desires a low cost material that allows for quick and automated application, which are easy to use by the consumer.

However, on some of the larger or bulky information handling systems, consumers have experienced dissatisfaction with the packaging. Because of the snug fit formed between the packaged system and the shipping box and the weight/size of the system, consumers found it difficult to remove the system from the shipping box. In some instances, the packing foam would "stick" to the shipping box preventing the removal of the system. In certain situations, the "stuck" packing foam would cause the consumer to attempt removal of the system by using an elbow, leg, head or other body part to remove the shipping box while holding onto the packaged system. In another example, the consumer had to rock the system back and forth to remove the packaged system from the box.

FIG. 1 illustrates a prior art packing foam unit that is one attempt to correct this problem. As shown, computer system 9 is set between bottom packing foam panel 4 and top packing foam panel 6. Top packing foam panel 6 and bottom packing foam panel 4 encloses system 9 when placed inside of shipping box 2, which includes box tops 2*a*. Once received, the consumer opens the shipping box 2 at top panels 2*a* and removes top packing foam panel 6 in order to remove computer system 9. However, this arrangement requires a significant amount of shipping material and a cost increase for each packed system.

Another attempt to correct this problem creates the shipping foam in four separate pieces instead of two. The four separate pieces would be placed two along the bottom edges and two along the top edges. Thus, the consumer would merely remove the top edge pieces in order to remove the system. However, this attempt causes factory throughput problems since there are four pieces to install instead of two. This attempt becomes even more difficult when applied in an automated facility.

SUMMARY

Thus, a need has arisen for breakaway foam packaging.

In accordance with teachings of the present disclosure, in some embodiments, the present disclosure teaches a breakaway packing system for packaging an information handling system including a packing support designed to receive at least a portion of an information handling system. The packing support secures the information handling system within a shipping container. The breakaway packing system also includes at least one detachable joint formed in the packing support. The detachable joint operably detachable to cause the packing support to separate into sections.

In other embodiments, an information handling system packaged for shipping including a printed circuit board, at least one processor, a memory, a chassis, a detachable container support, and at least one joint. The processor operably coupled to the printed circuit board. The memory operably coupled to the processor and the printed circuit board. The chassis enclosed around the printed circuit board, the memory, and the processor. The detachable container support designed to receive at least a portion of the chassis of the information handling system. The container support operable to secure the information handling system within a shipping container. The joint formed in the container support. The joint operably detachable to cause the container support to separate into a first section and a second section.

In further embodiments, a method of packing an information handling system includes placing a portion of a chassis of an information handling system into a packing support such that at least one edge of the chassis is secured within the packing support. The method further includes inserting the information handling system into a shipping container such that the packing support forms a protective barrier between the shipping container and the information handling system. Lastly, the method includes, upon arrival at the destination, detaching the packing support into sections by separating the detachable joints to allow removal of the information handling system from the shipping container.

All, some, or none of these technical advantages may be present in various embodiments of the present invention. Other technical advantages will be apparent to one skilled in the art from the following figures, descriptions, and claims.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein:

FIG. 2 is a block diagram showing an information handling system, according to teachings of the present disclosure;

DETAILED DESCRIPTION

Figure 1:
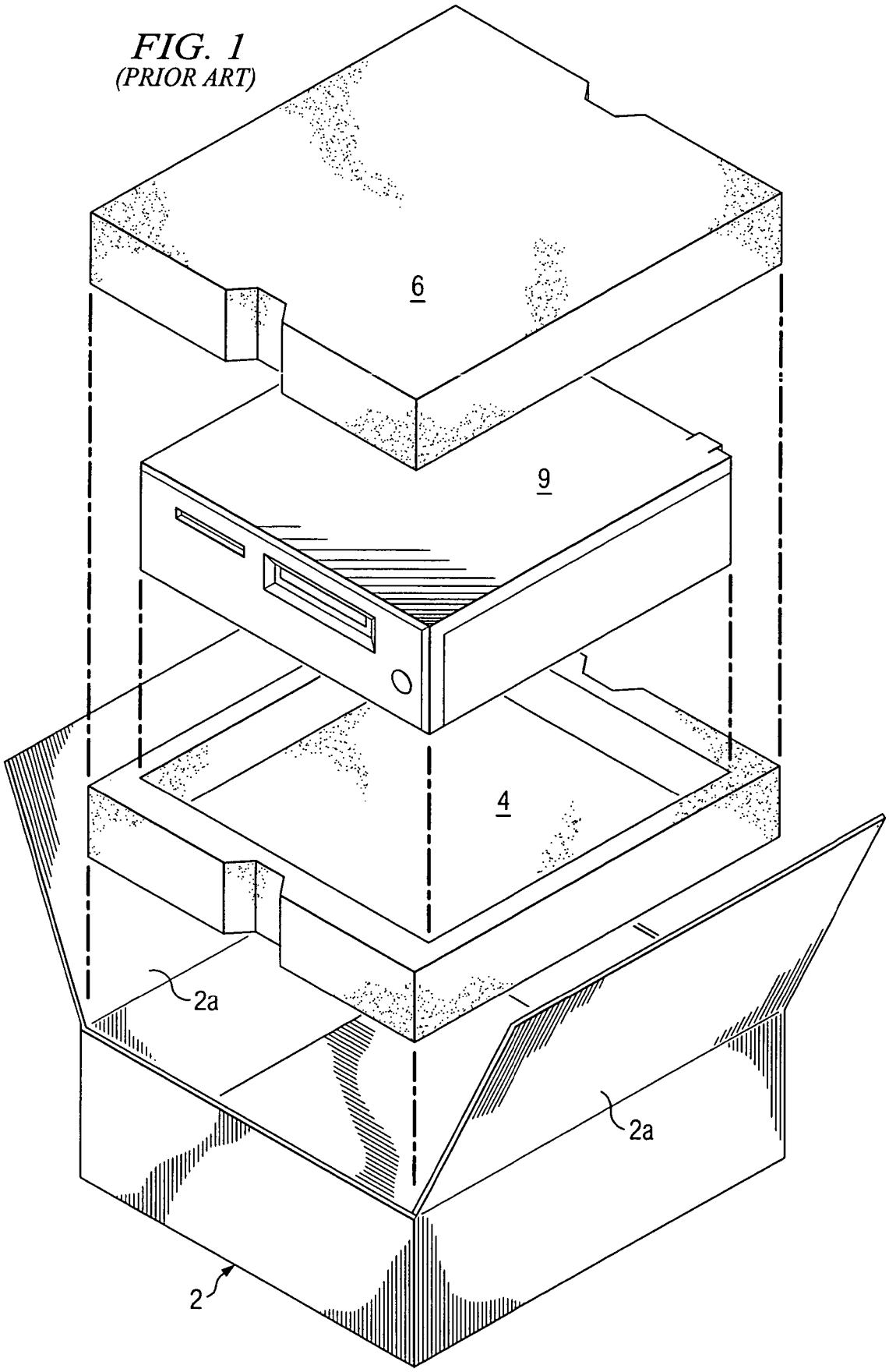
FIG. 1 (PRIOR ART)
FIG. 1 is an example of a prior art packing foam unit.

Preferred embodiments and their advantages are best understood by reference to FIGS. 2 through 5B, wherein like numbers are used to indicate like and corresponding parts.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Referring first to FIG. 2, a block diagram of information handling system 10 is shown, according to teachings of the present disclosure. Information handling system 10 or computer system preferably includes at least one microprocessor or central processing unit (CPU) 12. CPU 12 may include processor 14 for handling integer operations and coprocessor 16 for handling floating point operations. CPU 12 is preferably coupled to cache 18 and memory controller 20 via CPU bus 22. System controller I/O trap 24 preferably couples CPU bus 22 to local bus 26 and may be generally characterized as part of a system controller.

Main memory 28 of dynamic random access memory (DRAM) modules is preferably coupled to CPU bus 22 by a memory controller 20. Main memory 28 may be divided into one or more areas such as system management mode (SMM) memory area (not expressly shown).

Basic input/output system (BIOS) memory 30 is also preferably coupled to local bus 26. FLASH memory or other nonvolatile memory may be used as BIOS memory 30. A BIOS program (not expressly shown) is typically stored in BIOS memory 30. The BIOS program preferably includes software which facilitates interaction with and between information handling system 10 devices such as a keyboard (not expressly shown), a mouse (not expressly shown), or one or more I/O devices. BIOS memory 30 may also store system code (note expressly shown) operable to control a plurality of basic information handling system 10 operations.

Graphics controller 32 is preferably coupled to local bus 26 and to video memory 34. Video memory 34 is preferably operable to store information to be displayed on one or more display panels 36. Display panel 36 may be an active matrix or passive matrix liquid crystal display (LCD), a cathode ray tube (CRT) display or other display technology. In selected applications, uses or instances, graphics controller 32 may also be coupled to an integrated display, such as in a portable information handling system implementation.

Bus interface controller or expansion bus controller 38 preferably couples local bus 26 to expansion bus 40. In one embodiment, expansion bus 40 may be configured as an Industry Standard Architecture ("ISA") bus. Other buses, for example, a Peripheral Component Interconnect ("PCI") bus, may also be used.

In certain information handling system embodiments, expansion card controller 42 may also be included and is preferably coupled to expansion bus 40 as shown. Expansion card controller 42 is preferably coupled to a plurality of information handling system expansion slots 44. Expansion slots 44 may be configured to receive one or more computer components 80 (shown below in more detail) such as an expansion card (e.g., modems, fax cards, communications cards, and other input/output (I/O) devices).

Interrupt request generator 46 is also preferably coupled to expansion bus 40. Interrupt request generator 46 is preferably operable to issue an interrupt service request over a predetermined interrupt request line in response to receipt of a request to issue interrupt instruction from CPU 12.

I/O controller 48, often referred to as a super I/O controller, is also preferably coupled to expansion bus 40. I/O controller 48 preferably interfaces to an integrated drive electronics (IDE) hard drive device (HDD) 50, CD-ROM (compact disk-read only memory) drive 52 and/or a floppy disk drive (FDD) 54. Other disk drive devices (not expressly shown) which may be interfaced to the I/O controller include a removable hard drive, a zip drive, a CD-RW (compact disk-read/write) drive, and a CD-DVD (compact disk-digital versatile disk) drive.

Communication controller 56 is preferably provided and enables information handling system 10 to communicate with communication network 58, e.g., an Ethernet network. Communication network 58 may include a local area network (LAN), wide area network (WAN), Internet, Intranet, wireless broadband or the like. Communication controller 56 may be employed to form a network interface for communicating with other information handling systems (not expressly shown) coupled to communication network 58.

As illustrated, information handling system 10 preferably includes power supply 60, which provides power to the many components and/or devices that form information handling system 10. Power supply 60 may be a rechargeable battery, such as a nickel metal hydride ("NiMH") or lithium ion battery, when information handling system 10 is embodied as a portable or notebook computer, an A/C (alternating current) power source, an uninterruptible power supply (UPS) or other power source.

Power supply 60 is preferably coupled to power management microcontroller 62. Power management microcontroller 62 preferably controls the distribution of power from power supply 60. More specifically, power management microcontroller 62 preferably includes power output 64 coupled to main power plane 66 which may supply power to CPU 12 as well as other information handling system components. Power management microcontroller 62 may also be coupled to a power plane (not expressly shown) operable to supply power to an integrated panel display (not expressly shown), as well as to additional power delivery planes preferably included in information handling system 10.

Power management microcontroller 62 preferably monitors a charge level of an attached battery or UPS to determine when and when not to charge the battery or UPS. Power management microcontroller 62 is preferably also coupled to main power switch 68, which the user may actuate to turn information handling system 10 on and off. While power management microcontroller 62 powers down one or more portions or components of information handling system 10, e.g., CPU 12, display 36, or HDD 50, etc., when not in use to conserve power, power management microcontroller 62 itself is preferably substantially always coupled to a source of power, preferably power supply 60.

Computer system, a type of information handling system 10, may also include power management chip set 72. Power management chip set 72 is preferably coupled to CPU 12 via local bus 26 so that power management chip set 72 may receive power management and control commands from CPU 12. Power management chip set 72 is preferably connected to a plurality of individual power planes operable to supply power to respective components of information handling system 10, e.g., HDD 50, FDD 54, etc. In this manner, power management chip set 72 preferably acts under the direction of CPU 12 to control the power supplied to the various power planes and components of a system.

Real-time clock (RTC) 74 may also be coupled to I/O controller 48 and power management chip set 72. Inclusion of RTC 74 permits timed events or alarms to be transmitted to power management chip set 72. Real-time clock 74 may be programmed to generate an alarm signal at a predetermined time as well as to perform other operations.

Information handling system 10 is typically associated with chassis 70. Generally, chassis 70 is referred to as the computer case or case that encloses the components of information handling system 10; however, some components such as CD 52, floppy 54 and HDD 50, may be separately connected to information handling system 10 and are typically referred to as an external unit. During shipping, packing foam (shown below in more detail) is usually placed or coupled to a portion of chassis 70 to protect information handling system 10 during shipment or storage.

Figure 3:
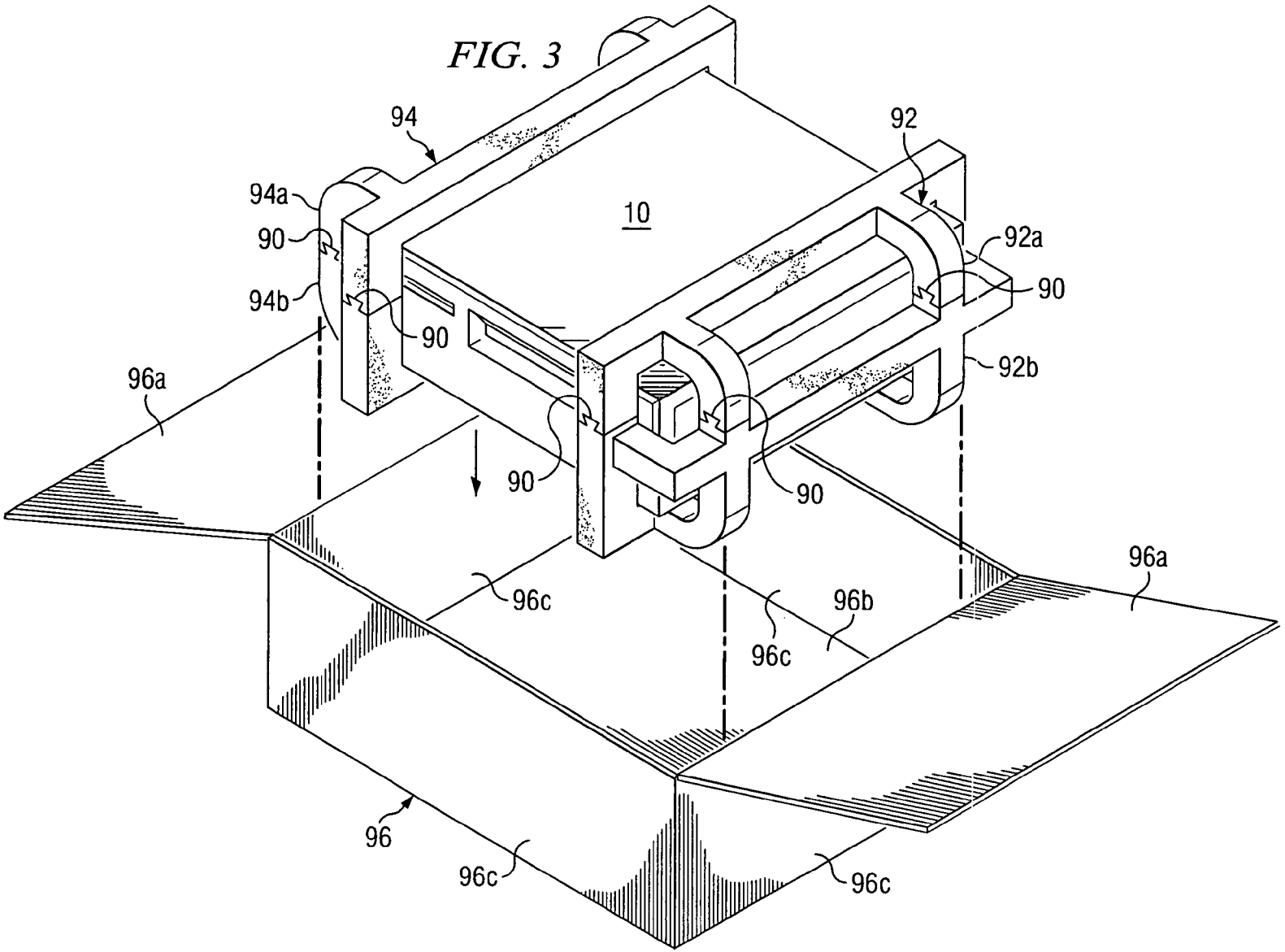
FIG. 3 illustrates a perspective view of a breakaway packing material attached to the ends of an information handling system, according to teachings of the present disclosure.

FIG. 3 illustrates a perspective view of breakaway packing 92 and 94 attached to the ends of information handling system 10. Breakaway packing 92 and 94 including detachable joint 90 are generally applied to a portion of information handling system 10 before being placed in shipping box 96. Typically, breakaway packing 92 and 94 is placed over each end of information handling system 10 to secure information handling system 10 during shipping or storage. As shown, breakaway packing 92 and 94 is formed to receive a portion of information handling system 10. Typically, the portion received is an end portion of information handling system 10 that may then be placed inside of shipping box 96.

Shipping box 96 is generally formed with bottom member 96*b*, side members 96*c* and top members 96*a*. Top members 96*a* may include one or more pieces generally formed to fit together to enclose information handling system 10 once placed within shipping box 96. Typically, top members 96*a* are hinged or removed to open shipping box 96 such that access to the interior of shipping box is permitted.

As shown, breakaway packing 92 is coupled to one end of information handling system 10 and breakaway packing 94 is coupled to the other end of information handling system 10 to secure system 10 within shipping box 96. Generally, the difference between breakaway packing 92 and 94 is that each is shaped or sized to receive their respective portions of information handling system 10.

Although breakaway packing 92 and 94 are shown, other breakaway packing materials may include a variety of sizes and shapes as determined by the packing or shipping need of information handling system 10. In some embodiments, information handling system 10 is appropriately sized or shaped such that only one style of breakaway packing can be used. In certain embodiments of the present disclosure, information handling system 10 uses at least one breakaway packing for shipping or storing information handling system 10.

At least one detachable joint 90 is formed in breakaway packing 92 and 94. The one or more detachable joints 90 are formed to allow one section of breakaway packing 92 and 94 separate from the remaining portion. Typically, the remaining portion of breakaway packing 92 and 94 remains in shipping box 96 still supporting information handling system 10. For example, breakaway packing 92 and 94 may separate at detachable joints 90 into top section 92*a* and 94*a* and bottom section 92*b* and 94*b*. After the separation of breakaway packing 92 and 94, a user will have the ability to access and remove information handling system 10 from shipping box 96.

In one preferred embodiment, breakaway packing 92 and 94 are placed over each end of information handling system 10 in an automated process. The automated process, such as a computer system assembly or packaging area, automatically couples breakaway packing 92 and 94 on each end of information handling system 10 before placing the packed system 10 into shipping box 96. Detachable joint 90 is formed such that handling and manipulation by the automated equipment does not cause breakaway foam packing to become detached. Once boxed, information handling system 10 may be shipped to a distribution location or to a consumer.

Figure 4:
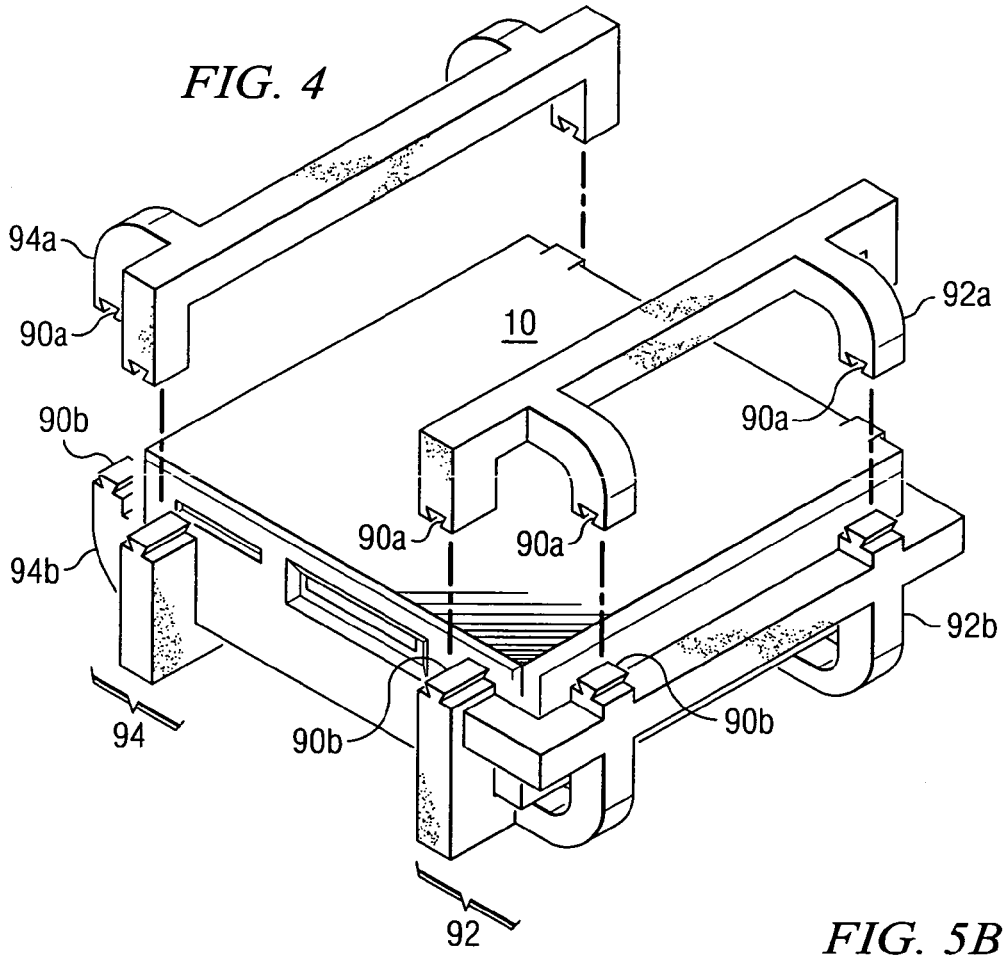
FIG. 4 illustrates one end of the information handling system with a top portion of the breakaway packing material detached from a bottom portion, according to an example embodiment of the present disclosure.

FIG. 4 illustrates information handling system 10 with top sections 92*a* and 94*a* of breakaway packing material 92 and 94 separated from bottom portions 92*b* and 94*b*. Typically, breakaway packing material 92 and 94, which are placed on the ends of information handling system 10, are set within shipping box 96 (not shown for clarity).

Generally, unsealing and displacing top flaps 96*a* opens shipping box 96 (not shown for clarity) to expose a portion of information handling system 10, such as a side panel of a server or a large computer system. Because breakaway packing material 92 and 94 are typically formed to protect information handling system 10 from all sides during the shipping, at least a portion of breakaway packing material 92 or 94 will be covering the exposed portion of information handling system 10. By removing the portion of breakaway packing material 92 and 94 covering the exposed portion of information handling system 10, a user will be able to remove information handling system 10 from shipping box 96.

Breakaway packing materials 92 and 94 include detachable joint 90. In some embodiments, detachable joint 90 is formed to include top joint 90*a* and bottom joint 90*b*. Although top joint 90*a* is shown as part of top sections 92*a* and 94*a* and bottom joint 90*b* is shown as part of bottom sections 92*b* and 94*b*, top joint 90*a* and bottom joint 90*b* may be used interchangeably on any section.

Detachable joint 90 is preferably set at one or more locations in each breakaway packing material 92 and 94 to allow each packing material to separate into two or more sections. Typically, detachable joints 90 are set at advantageous locations along breakaway packing materials 92 and 94 to allow top sections 92*a* and 94*a* to be removed from shipping box 96 (not shown). Once removed, information handling system 10 can be easily removed from shipping box 96 (not shown), generally leaving bottom portions 92*b* and 94*b* remaining in shipping box 96.

Typically, detachable joint 90 is formed and designed such that the joint is reusable. As such, a user may be able to repack information handling system 10 within shipping box 96 (not shown).

Figure 5A:
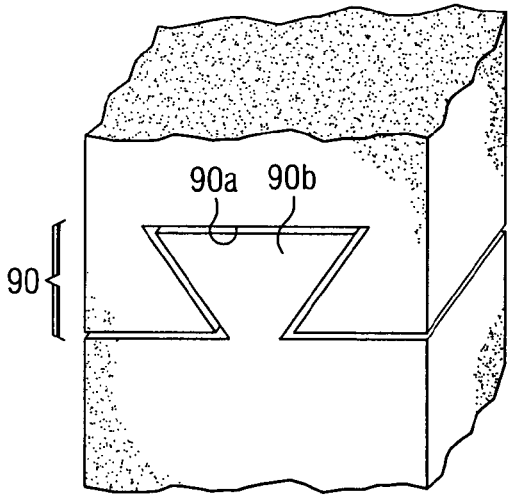
FIGS. 5A and 5B illustrate an example embodiment of a detachable joint of the breakaway packing material in an attached position and in a detached position, according to teachings of the present disclosure.
Figure 5B:
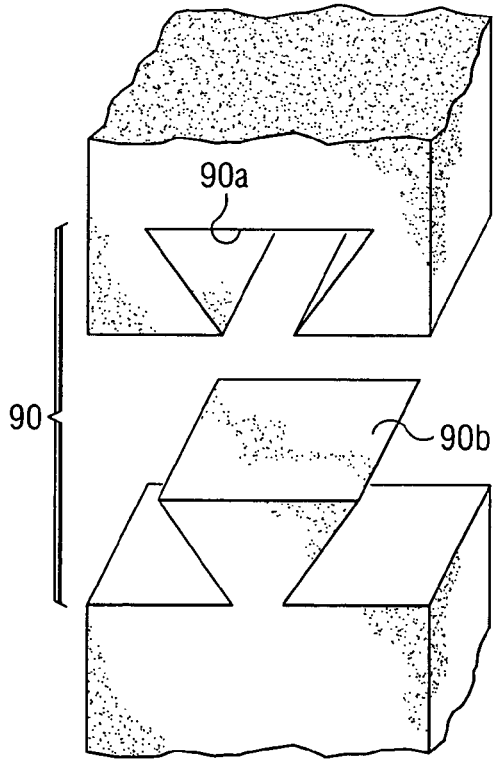

FIGS. 5A and 5B illustrate an example embodiment of detachable joint 90 of breakaway packing material 92 and 94 in an attached position and in a detached position. As illustrated in FIG. 5A, detachable joint 90 remains connected such that breakaway packing material 92 and 94 (not shown) remain intact. However, given sufficient force, detachable joint 90 may be separated into top section 90*a* and bottom section 90*b* as shown in FIG. 5B.

As shown, detachable joint 90 may be formed as a dovetail joint. In other embodiments, detachable joint may include a variety of different fastening joints. Typically, the fastening joints are selected to allow for reattachment or joining of the joint.

Another design factor that may influence the selecting a particular joint is the strength of the joint. Generally, the joint needs to withstand the manipulation or handling by an automated process and yet remain intact. However, a user should be able to easily separate the joint in order to remove information handling system 10.

Generally, detachable joint 90 is formed into a portion of breakaway packing material 92 and 94. In some embodiments, detachable joint 90 is formed during the manufacturing process of breakaway packing materials 92 and 94 such that detachable joint 90 is formed as part of breakaway packing materials 92 and 94 from the manufacturer. For example, detachable joint 90 may be formed in a die cutting process such that the joint is cut as part of the die that cuts the packing material into the proper shape. However, it is possible that some packing materials may be retrofitted in a subsequent manufacturing process to include a joint such as detachable joint 90.

Typically, the material used for making breakaway packing material 92 and 94 is the same for detachable joint 90. Generally, breakaway packing materials 92 and 94 comprise foam, a foam-type material, any suitable packing material, or any combination thereof. In some embodiments, the selection of materials allows for detachable joint 90 to be readily compressible for separating and reattaching several times.

Although the disclosed embodiments have been described in detail, it should be understood that various changes, substitutions and alterations can be made to the embodiments without departing from their spirit and scope.

What is claimed is:

1. A breakaway packing system for packaging an information handling system, the information handling system having the shape of a rectangular cube with eight corners and six sides, the breakaway packing system comprising:

a packing support designed to receive at least a portion of an information handling system, the packing support operable to secure the information handling system within a shipping container, the packing support comprising a top section and a bottom section;

the top section including at least eight top section joint portions, the bottom section including at least eight bottom section joint portions;

at least eight detachable joints formed in the packing support, each of the detachable joints comprising a joint between one of the top section joint portions of the top section and one of the bottom section joint portions of the bottom section;

the at least eight detachable joints located around the perimeter of the breakaway packing system so that at least two of the at least eight detachable joints are located on four sides of the six sides of the information handling system when the top section and the bottom section are assembled;

the packing support configured to expose all eight corners of the information handling system when the top section and the bottom section are assembled; and the at least eight detachable joints operable to hold the top section and the bottom section together while the information handling system is being packed but to allow the top section to be detached from the bottom section after the information handling system is packed, thereby allowing removal of the information handling system from the shipping container.

2. The breakaway packing system of claim 1, wherein the detachable joints are reusable such that the packing support can be rejoined for shipping the information handling system.

3. The breakaway packing system of claim 1, wherein the packing support comprises a foam material.

4. The breakaway packing system of claim 1, further comprising the packing support operably coupled to the information handling system during an automated process.

5. The breakaway packing system of claim 1, wherein the detachable joints are formed in a die cutting process.

6. The breakaway packing system of claim 1, wherein the detachable joints comprise dovetail joints.

7. An information handling system packaged for shipping, comprising:

a printed circuit board;

at least one processor operably coupled to the printed circuit board;

a memory operably coupled to the processor and the printed circuit board;

a chassis enclosed around the printed circuit board, the memory, and the at least one processor, the chassis having the shape of a rectangular cube with eight corners and six sides;

a detachable container support designed to receive at least a portion of the chassis of the information handling system, the container support operable to secure the information handling system within a shipping container, the packing support comprising a first section and a second section; and the first section including at least eight first section joint portions, and the second section including at least eight second section joint portions;

at least eight detachable joints formed in the container support, each of the detachable joints comprising a joint between one of the first section joint portions of the first section and one of the second section joint portions of the second section;

the at least eight detachable joints located around the perimeter of the chassis so that at least two of the at least eight detachable joints are located on four sides of the six sides of the chassis;

the detachable container support configured to expose all eight corners of the chassis; and the at least eight detachable joints operable to hold the top section and the bottom section together while the information handling system is being packed but to allow the first section to be detached from the second section after the information handling system is packed, thereby allowing removal of the information handling system from the shipping container.

8. The information handling system packaged for shipping of claim 7, wherein the detachable joints are reusable such that the first section can be rejoined with the second section for shipping the information handling system.

9. The information handling system packaged for shipping of claim 7, wherein the packing support comprises a foam material.

10. The information handling system packaged for shipping of claim 7, wherein the detachable joints comprise dovetail joints.

11. The information handling system packaged for shipping of claim 7, further comprising the packing support operably coupled to the information handling system by an automated process.

12. The information handling system packaged for shipping of claim 7, wherein the detachable joints are formed by a die cutting process.

13. A breakaway apparatus suitable for packaging an information handling system, the information handling system having six sides and eight corners, the apparatus comprising:

a first upper packing support including:

an elongated C-shaped member configured to extend from a first side of the information handling system across a second side of the information handling system and to a third side of the information handling system opposite the first side; and at least one arm extending substantially perpendicular from a portion of the C-shaped member to a fifth side of the information handling system;

a first lower packing support;

wherein the first upper packing support defines upper portions of a first set of at least four detachable joints;

wherein the first lower packing support defines lower portions of the first set of detachable joints;

wherein at least one detachable joint is located adjacent the first side of the information handling system, at least one detachable joint is located adjacent the third side of the information handling system, and at least two detachable joints are located adjacent the fifth side of the information handling system;

further comprising the first upper packing support and the first lower packing support configured to expose all four corners of the fifth side when the first upper packing support and the first lower packing support are joined; and wherein upper and lower portions of the first set of detachable joints interlock with each other to detachably secure the first upper packing support to the first lower packing support such that the first set of detachable joints provide some resistance to separating the first upper packing support from the first lower packing support, but allow the first upper packing support to be completely separated from the first lower packing support.

14. The breakaway apparatus of claim 13, further comprising:

a second upper packing support including:

an elongated C-shaped member configured to extend from the first side of the information handling system across the second side of the information handling system and to the third side of the information handling system opposite the first side; and at least one arm extending substantially perpendicular from a portion of the C-shaped member to a sixth side of the information handling system;

a second lower packing support and a second set of at least three detachable joints operable to detachably secure the second upper packing support to the second lower packing support such that the second set of detachable joints provide some resistance to separating the second upper packing support from the second lower packing support.

15. The breakaway apparatus of claim 14, wherein the first and second upper and lower packing supports comprise a foam material.

16. The breakaway packing system of claim 14, wherein a number of joints in each of the first and second sets of detachable joints is at least eight.

17. The breakaway apparatus of claim 13, wherein the first upper and lower packing supports both include a pair of curved arm members extending from the elongated C-shaped member.

18. A breakaway apparatus suitable for packaging an information handling system, the information handling system having eight corners, the apparatus comprising:

a first upper packing support to receive first and second corners of the information handling system, the first upper packing support comprising a c-shaped member including a central member and a pair of curved arm members extending from the central member;

the first upper packing support configured to expose the first corner and the second corner of the information handling system; and a first lower packing support to receive third and fourth corners of the information handling system, the first lower packing support comprising a c-shaped member including a central member and a pair of curved arm members extending from the central member;

the first lower packing support configured to expose the third corner and the fourth corner of the information handling system; and wherein the first upper packing support defines upper portions of a first set of at least three detachable joints;

wherein the first lower packing support defines lower portions of the first set of detachable joints; and wherein upper and lower portions of the first set of detachable joints interlock with each other to detachably secure the first upper packing support to the first lower packing support such that the first set of detachable joints provide some resistance to separating the first upper packing support from the first lower packing support, but allow the first upper packing support to be completely separated from the first lower packing support.

* * * * *